United States Patent [19]

Gravemann

[11] 4,421,570

[45] Dec. 20, 1983

[54] MAKING MOLDS FOR CONTINUOUS CASTING

[75] Inventor: Horst Gravemann, Osnabrück, Fed. Rep. of Germany

[73] Assignee: Kabel und Metallwerke Gutehoffnungshutte AG, Hanover, Fed. Rep. of Germany

[21] Appl. No.: 357,683

[22] Filed: Mar. 12, 1982

[51] Int. Cl.[3] ..... C22F 1/08

[52] U.S. Cl. ..... 148/11.5 C; 148/12.7 C

[58] Field of Search ..... 148/12.7 C, 411; 420/485, 492

[56] References Cited

U.S. PATENT DOCUMENTS 3,170,204 2/1965 Tarmann ..... 148/411

3,830,644 8/1974 Watanabe et al. ..... 148/411

3,988,176 10/1976 Watanabe et al. ..... 148/411

4,179,314 12/1979 Wikle ..... 148/12.7 C

FOREIGN PATENT DOCUMENTS 2533528 2/1976 Fed. Rep. of Germany .

*Primary Examiner*—Peter K. Skiff

*Attorney, Agent, or Firm*—Ralf H. Siegemund

[57] ABSTRACT

An age-hardening copper alloy is used, alloy components being zirconium, nickel, chromium, cobalt, phosphorus, and beryllium, to make a tubular blank and solution heat-treating same; after a cold-working step, the pre-sized blank is age-hardened at from 400° C. to 600° C. for at least 15 minutes and explosion-formed in order to obtain thedesired size, shape, and dimensions.

9 Claims, No Drawings

MAKING MOLDS FOR CONTINUOUS CASTING

BACKGROUND OF THE INVENTION

The present invention relates to a method of making tubular, curved or straight molds for continuous casting, under utilization of a copper alloy.

German printed patent application No. 25 33 528 discloses a method of making such a mold by deforming a copper or copper alloy blank by means of explosives for forming the blank in order to obtain the desired contour of the mold. This method offers the advantage of a high-quality surface of the resulting mold; also, the dimensions of the cavity attained in this fashion are very accurate. Additionally, the surface of the mold is actually hardened. Assuming, for instance, an original hardness of 40 Rockwell B, the explosive-forming method above will result in a hardness of from 50 to 75 Rockwell B.

The explosion deforming or forming as described is disadvantaged by the fact that the resulting wall thickness is too low to permit any significant subsequent reduction, e.g., by means of cold-working. Consequently, the overall strength of the mold and, therefore, the stability as to shape and integrity of the cross section is fairly poor. Moreover, cold-working is usually employed in order to strengthen the material; but as soon as the temperature rises to 350° C., that process reverses itself so that a highly used mold wears out rather quickly. The mold's strength can be increased to some extent through appropriate selection of the copper alloy constituents. Unfortunately, the heat conduction goes down; and such a mold may have the tendency of cracking in the surface level of the molten material.

DESCRIPTION OF THE INVENTION

It is an object of the present invention to provide a new and improved method of making molds for continuous casting without restrictions as to wall thickness, preferably for making castings of a large diameter. Moreover, the mold is to have (a) a very great strength over its entire wall thickness, (b) a high softening temperature, and (c) a high thermal strength. Moreover, it should be possible to select alloying components so that magnetic stirring is made possible; furthermore, electrical conduction and heat transfer characteristics should be subject to control.

It is, therefore, a specific object of the present invention to provide a new and improved method for making molds for continuous casting under utilization of the explosive type forming technique.

In accordance with the preferred embodiment of the present invention, the objects thereof are obtained by using a tubular blank of an age-hardening copper alloy which blank is solution heat treated at a temperature within a range that is appropriate for the particular alloy; alternatively, the tubular blank is formed at such a temperature; subsequently, the tube is age-hardened for at least 15 minutes at a temperature of between 400° C. and 600° C.; finally, the tube is explosion-formed in order to obtain its final dimensions. In the case of making a curved mold, a bending step is interposed between the annealing and the age-hardening. The mold walls, particularly of the cavity, can be straight or curved, round or rectangular, tapered or conical.

Molds made by the afore-described steps have strength values which are considerably higher than the ones in conventionally made molds, the reason being that an age-hardening copper alloy has been used. The strength increase during age-hardening at 400° C. to 600° C. is attained by internal precipitation. The thus improved mold lasts longer, retains its shape better, particularly under thermal load and tension, and wears out less, particularly because of reduced abrasion.

The mechanical strength of the mold can be increased in furtherance of the invention by mechanically cold-working the annealed and soft tube. For instance, a mandrel is inserted into the tube prior to age-hardening, the mandrel being curved or straight as desired; and together, they are pulled through a drawing die. The degree of cold deformation may be chosen to be between approximately 2% up to approximately 30%, depending upon desired strength enhancement.

The subsequent age hardening results in very high strength values; therefore, it is desirable to size the mold already after the initial annealing in order to obtain the desired geometry and dimensions of the mold, in particular, of its cavity. During age hardening, some distortion may occur, but that will be compensated by the final explosion-forming step; and one obtains an optimum product, indeed.

The copper alloy to be used depends upon the specific requirements for the type of mold and its intended use. An age-hardening alloy for a wide variety of uses will include 0.3° to 1.2° chromium and 0.05% to 0.2% zirconium, the remainder being copper; These and all following percentages are by weight. This particular copper alloy exhibits the requisite high thermal conductivity for a mold for continuous casting. Conventional molds are made from SF copper or a copper silver phosphorous alloy; but the presently proposed copper chromium zirconium alloy, worked in accordance with the invention, has a much higher temperature strength and persistence to wear and abrasion; such a mold is almost completely free from contour deformation and distortion and has a long life.

EXAMPLES (1) In the following, the making of a copper chromium zirconium mold will be described with reference to a specific example:

A copper alloy having 0.7% chromium and 0.18% zirconium, the remainder being copper and the usual impurities, was used to cast a pin, i.e., a round, cylindrical blank or billet. This blank or billet was extruded at 1,030° C. in order to obtain a tube, which was then quenched in water. This particular working and tube-forming step served also as the initial solution heat treatment of annealing step for the material. Certain tubular lengths were cut from this tube and pre-bent in an appropriate bending machine.

A circular die member was introduced into such a cut tube and explosive charges were uniformly distributed around the periphery of that tube and fired. This particular step served as a cold-working step to enhance the strength of the material and to pre-size the tube. Thereafter, the die member was removed from the tube, and the latter was age-hardened at 475° C. for four-and-one-half hours. The shape of the thus treated tube was slightly distorted. Therefore, after cooling a die was inserted, having a cross section which did exactly correspond to the cross section of the mold cavity to be made. This die was slightly curved and, of course, the orientation of the curvatures have to match. Thereafter, another explosion deformation step was performed, just as described above, which constituted another cold-working step by means of which the mold attained the desired dimensions.

The mold made in this manner did exhibit the following properties:

Thermal conductivity: 87% (of pure copper)
Softening temperature: 525° C.
Hardness HB 2.5/62.5: 145
Tensile strength: 442 Newtons/mm$^2$
Yield point (elongation at rupture): 26%
High temperature strength:
220° C.: 380 N/mm$^2$
350° C.: 318 N/mm$^2$
10% drop in strength at room temperature after one hour of age-hardening.

This mold has retained its dimensions even after 450 runs of casting charges, particularly in the level of the surface of the molten material. Only the bottom of the mold exhibited some wear.

(2) A straight mold with conical (tapered), rectangular cross section was made from the same copper chromium zirconium alloy, in accordance with the following example. This mold was still stronger.

A round tube was made by extrusion at 950° C., and the rectangular (square) cross section resulted from a subsequent drawing step. This square tube was solution heat treated for 45 minutes at 990° C. Following cooling, suitable lengths were cut; and each length was sized and cold-worked by means of a mandrel and a die under reduction of the wall thickness by 15% in order to obtain the final dimension. Thereafter, the tubular pieces were age-hardened for six hours at 450° C. The final sizing was obtained by the above-mentioned explosion deformation.

The molds made in the afore-described manner did have the following properties:

Thermal conductivity: 84% (of pure copper)
Softening temperature: 510° C.
Hardness HB 2.5/62.5: 159
Tensile strength: 521 Newtons/mm$^2$
Elongation at rupture: 21%

This particular mold exhibited decidedly less wear at the bottom.

(3) In some cases, one needs a mold of a still higher thermal conductivity; for instance, when the quality of the cooling water is rather poor. The alloy may consist here of copper with just 0.05% to 0.3% zirconium. The working method is carried out as described. An interposed cold-working step raises to a tensile strength of up to 350 N/mm$^2$ at a thermal conductivity of above 93% of pure copper. This material softens at a temperature of above 550° C.

(4) Magnetic stirring is another special requirement, which means that the electrical conductivity of the mold should be quite low in order to make sure that the magnetic stirring field is not significantly weakened. Unfortunately, the thermal conductivity drops with the electrical conductivity so that the mold wall temperatures will be quite high during casting. Thus, in order to avoid thermal deformation of the mold, its strength must retain high values, even at high operating temperatures.

In accordance with the invention, it was found that, for instance, an age-hardening copper-nickel-phosphorous alloy is well suited for such a purpose; particularly, a composition of 0.6% to 1.5% Ni and 0.1% to 0.3% P (remainder being copper plus impurities). Alternatively, a copper-cobalt-beryllium alloy or a copper-nickel-beryllium alloy can be used with 1 to 2.5% Co; or 1 to 2.5% Ni; or 0.5 to 1.5% Ni plus 0.5 to 1.5% Co, and 0.3 to 0.6% beryllium in each instance (remainder Cu plus impurities). Another alloy consists of copper nickel silicon with 0.2 to 1.1% Si and 1.2 to 3.5% Ni (remainder Cu plus impurities).

A copper cobalt-beryllium alloy with 2.2% Co and 0.54 Be (remainder Cu and impurities) was used to make a rectangular, tubular mold at interior dimensions of 200 mm by 220 mm; wall thickness 14 mm.

A near-square tube was made by extrusion and solution heat treated for 45 minutes at 935° C. A bending machine provided the desired curving. After cutting, the lengths were explosion deformed as described and sized over a mandrel. Each piece was then age-hardened at 480° C. for five hours. Any distortion that may have resulted was eliminated by another explosion deforming over a mandrel, and the resulting molds were sized again.

A mold made as per the last-mentioned method did have the following properties:

Thermal conductivity: 54% (of pure copper)
Softening temperature: 505° C.
Hardness HB 2.5/62.5: 235
Tensile strength: 805 N/mm$^2$
Elongation at rupture: 17%
High temperature strength:
200° C.: 735 N/mm$^2$
350° C.: 622 N/mm$^2$ Such a mold was then used in conjunction with magnetic stirring, and the low field attenuation resulted in a significantly improved stirring effect. The mold retained its size even after 100 casting runs.

The invention is not limited to the embodiments described above; but all changes and modifications thereof, not constituting departures from the spirit and scope of the invention, are intended to be included.

I claim:

1. A method of making tubular, curved or straight molds for continuous casting, comprising the steps of
providing an age-hardening copper alloy;
making a tube from the alloy;
solution heat-treating the tube material;
subsequently age-hardening the tube at from 400° C. to 600° C. for at least 15 minutes for obtaining internal precipitation; and
cold-working the tube by explosion-forming in order to obtain its final size as to its interior serving as a mold cavity.

2. The method as in claim 1, including the step of cold-working the tube after the heat treatment prior to the age-hardening.

3. The method as in claim 2, the cold-working step being another explosion-forming step.

4. The method as in claim 2, the cold-working step including placing a mandrel into the tube and drawing the tube through a die.

5. The method as in claim 1, using a copper alloy of 0.3% to 1.2% chromium and 0.05% to 0.2% zirconium, the remainder being copper and spurious impurities.

6. The method as in claim 1, using a copper alloy of copper with 0.05% to 0.3% zirconium.

7. The method as in claim 1, using a copper alloy with 0.6% to 1.5% Ni and 0.1% to 0.3% P.

8. The method as in claim 1, using a copper alloy with 1% to 5% Co or 1% to 2.5% Ni or 0.5% to 1.5% Ni and 1.5% Co; and 0.3% to 0.6% Be.

9. The method as in claim 1, using a copper alloy with 0.2% to 1.1% Si and 1.2% to 3.5% Ni.

* * * * *